US010137713B2

(12) United States Patent
Ando

(10) Patent No.: US 10,137,713 B2
(45) Date of Patent: Nov. 27, 2018

(54) THERMAL PRINTER AND PORTABLE TERMINAL

(71) Applicant: Seiko Instruments Inc., Chiba-shi, Chiba (JP)

(72) Inventor: Norihisa Ando, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 15/657,450

(22) Filed: Jul. 24, 2017

(65) Prior Publication Data

US 2018/0029389 A1 Feb. 1, 2018

(30) Foreign Application Priority Data

Jul. 26, 2016 (JP) ..... 2016-146501

(51) Int. Cl.

| | |
|---|---|
| ***B41J 2/32*** | (2006.01) |
| ***B41J 15/04*** | (2006.01) |
| ***B41J 15/02*** | (2006.01) |
| ***B41J 29/00*** | (2006.01) |
| ***B41J 3/36*** | (2006.01) |
| ***B41J 11/00*** | (2006.01) |
| ***B41J 11/04*** | (2006.01) |

(52) U.S. Cl.

CPC ..... *B41J 15/046* (2013.01); *B41J 2/32* (2013.01); *B41J 3/36* (2013.01); *B41J 11/0095* (2013.01); *B41J 11/04* (2013.01); *B41J 15/02* (2013.01); *B41J 29/00* (2013.01); *B41J 2202/31* (2013.01)

(58) Field of Classification Search

CPC ... B41J 25/34; B41J 2/304; B41J 2/335; B41J 25/316; B41J 25/312; B41J 15/04; B41J 15/042; B41J 15/044; B41J 15/0475; B41J 25/304; B41J 25/308; B41J 25/3088; B41J 25/3086; B41J 25/3084; B41J 25/3082

See application file for complete search history.

(56) References Cited

U.S. PATENT DOCUMENTS

| | | | |
|---|---|---|---|
| 2011/0142521 | A1 | 6/2011 | Miyashita |
| 2013/0044178 | A1 | 2/2013 | Tsuchiya et al. |
| 2017/0144455 | A1 | 5/2017 | Ishikawa et al. |

FOREIGN PATENT DOCUMENTS

| | | | |
|---|---|---|---|
| EP | 1 179 433 | A2 | 2/2002 |
| JP | 2013-39779 | A | 2/2013 |
| JP | 2015-227008 | A | 12/2015 |

OTHER PUBLICATIONS

Extended Search Report in European Application No. 17183165.4, dated Nov. 29, 2017, 9 pages.

*Primary Examiner* — Kristal Feggins
(74) *Attorney, Agent, or Firm* — Brinks Gilson & Lione

(57) ABSTRACT

A thermal printer includes a head block having a head support plate and a thermal head fixed to the head support plate, a platen roller brought into abutment against the thermal head through intermediation of recording paper, a wiring board drawn from the thermal head, a frame supporting the platen roller and the head support plate, and a recording paper sensor mounted to the wiring board and detecting the recording paper. The frame includes a guide wall arranged on upstream of the thermal head in a conveyance direction of the recording paper, the guide wall guiding the recording paper to the thermal head. The head block including a sensor holder mounted thereto, the sensor holder holding the recording paper sensor at a portion which is located between the thermal head and the guide wall in the conveyance direction.

10 Claims, 5 Drawing Sheets

THERMAL PRINTER AND PORTABLE TERMINAL

RELATED APPLICATIONS

This application claims priority under 35 U.S.C. § 119 to Japanese Patent Application No. 2016-146501 filed on Jul. 26, 2016, the entire content of which is hereby incorporated by reference.

BACKGROUND OF THE INVENTION

1. Field of the Invention

The present invention relates to a thermal printer and a portable terminal.

2. Description of the Related Art

A thermal printer has been known as a printer configured to perform printing on recording paper (heat-sensitive paper). The thermal printer includes a head frame, a platen roller, and a head block. The platen roller is supported on the head frame so as to be rotatable. The head block is supported on the head frame so as to be turnable in directions of approaching and separating from the platen roller. The head block includes a thermal head and a head support plate. The thermal head includes heating elements. The head support plate is configured to support the thermal head. In the thermal printer, the platen roller is rotated under a state in which the recording paper is nipped between the platen roller and the thermal head, thereby conveying the recording paper. The heating elements of the thermal head are caused to generate heat as appropriate during a course of conveying the recording paper, thereby printing various information on the recording paper.

In the above-mentioned thermal printer, there is mounted a recording paper sensor configured to detect presence or absence of the recording paper or a position of the recording paper. When a photointerrupter (PI) sensor is used as the recording paper sensor, it is preferred that the recording paper sensor be arranged in the vicinity of the thermal head.

In many cases, in the vicinity of the thermal head, there is arranged a blocking member configured to block ambient light which may enter the recording paper sensor. For example, the blocking member may be a recording paper guide which defines, with the head frame, a paper passage for the recording paper. When the recording paper sensor is arranged in the vicinity of the thermal head, surroundings of the recording paper sensor are covered with the blocking member. Consequently, it is conceivable that erroneous detection by the recording paper sensor due to entry of the ambient light can be suppressed. In this connection, there has been known a related-art thermal printer having a configuration in which the recording paper sensor is arranged on a guide wall of the head frame, which is configured to guide the recording paper to the thermal head.

Incidentally, the above-mentioned recording paper sensor is mounted to a portion of a flexible board configured to supply power to the thermal head. Under a state in which the recording paper sensor is connected to the head block through intermediation of the flexible board, the recording paper sensor is integrally assembled together with the head block to the head frame. Specifically, the head block and the recording paper sensor are inserted into the head frame through a gap of the head frame, which is formed between the above-mentioned guide wall and a back surface plate opposed to the guide wall. After the recording paper sensor is held on the guide wall, the head block is caused to further proceed in the gap. At the time of insertion, there is a fear in that the flexible board is caught by the head frame and cannot be smoothly inserted into the gap. Therefore, there is still room for improvement in ease of assembly of the related-art thermal printer.

Meanwhile, there has been known a related-art thermal printer having a configuration in which the recording paper sensor is directly mounted to, for example, a head surface of the thermal head, which is to be brought into abutment against the platen roller. However, in order to secure detection accuracy of the recording paper sensor, it is necessary to allow the recording paper to pass within a desired detection range of the recording paper sensor. In the above-mentioned configuration, the recording paper sensor is directly mounted to the thermal head. Accordingly, a position or an orientation of the recording paper sensor is determined by a shape or a layout of the head surface of the thermal head. As a result, it is necessary to determine a conveyance path of the recording paper to the thermal head in accordance with a position or an orientation of the recording paper sensor, and there is a fear in that the degree of freedom in design of the conveyance path of the recording paper is degraded.

Therefore, for the thermal printer of this type, it has been demanded that, with the arrangement of the recording paper sensor in the vicinity of the thermal head, the ease of assembly and the degree of freedom in design of the conveyance path be improved.

SUMMARY OF THE INVENTION

According to one embodiment of the present invention, there is provided a thermal printer, including: a head block having a head support plate and a thermal head fixed to the head support plate; a platen roller brought into abutment against the thermal head through intermediation of recording paper; a wiring board drawn from the thermal head; a frame supporting the platen roller and the head support plate; and a recording paper sensor mounted to the wiring board and detecting the recording paper, the frame including a guide wall arranged on upstream of the thermal head in a conveyance direction of the recording paper, the guide wall guiding the recording paper to the thermal head, the head block including a sensor holder mounted thereto, the sensor holder holding the recording paper sensor at a portion which is located between the thermal head and the guide wall in the conveyance direction.

In the above-mentioned thermal printer according to the one embodiment of the present invention, wherein the frame is configured to support the platen roller rotatably about an axis extending in a first direction, and is configured to support the head support plate turnably in directions of causing the thermal head to approach and separate from the platen roller about a turn axis extending in the first direction.

In the above-mentioned thermal printer according to the one embodiment of the present invention, wherein the recording paper sensor comprises an optical sensor, wherein the sensor holder includes a cover portion covering the recording paper sensor, the cover portion guiding the recording paper to the thermal head between the guide wall and the thermal head, and wherein the cover portion includes a passing hole which allows light emitted from the recording paper sensor to pass.

In the above-mentioned thermal printer according to the one embodiment of the present invention, wherein the sensor holder is mounted to the head support plate.

In the above-mentioned thermal printer according to the one embodiment of the present invention, wherein a head surface of the thermal head, which is brought into abutment against the platen roller, extends in a direction intersecting a conveyance path of the recording paper connecting the guide wall and the thermal head to each other, and wherein the recording paper sensor is arranged in conformity with the conveyance path.

According to one embodiment of the present invention, there is provided a portable terminal, including: the above-mentioned thermal printer; and a casing to which the thermal printer is mounted.

DETAILED DESCRIPTION OF THE PREFERRED EMBODIMENTS

Figure 1:
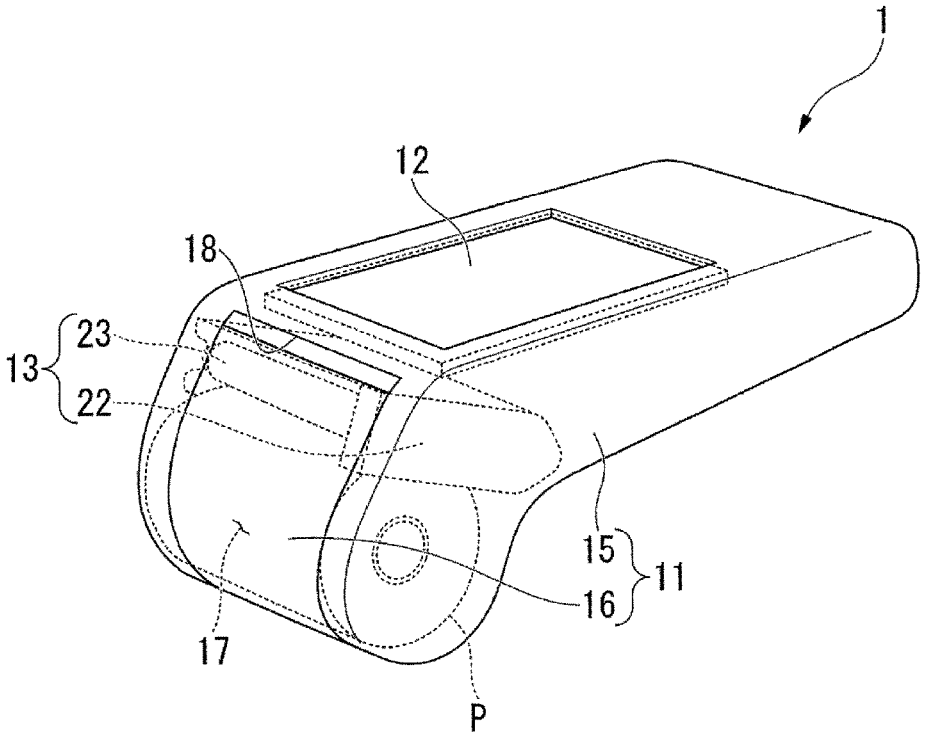
FIG. 1 is a perspective view of a portable terminal according to an embodiment of the present invention.

FIG. 1 is a perspective view of a portable terminal 1. As illustrated in FIG. 1, the portable terminal 1 is, for example, a payment terminal which is portable by a user. The portable terminal 1 includes a casing 11, an input display portion 12, and a thermal printer 13.

The casing 11 includes a casing main body 15 and a printer cover 16. The casing main body 15 is formed into a box shape having a rectangular shape in plan view. In a distal end portion of the casing main body 15, there is formed a recording paper receiving portion 17 configured to receive recording paper P (heat-sensitive paper). The recording paper P is received, under a state of being wound into a roll, in the recording paper receiving portion 17. The printer cover 16 is turnably connected to the casing main body 15 through intermediation of a hinge portion (not shown). The printer cover 16 is configured to open and close the recording paper receiving portion 17. In the casing 11, there is formed a discharge port 18, which is configured to discharge the recording paper P to the outside, between an opening edge of the recording paper receiving portion 17 and a distal edge of the printer cover 16. The input display portion 12 is arranged on a front surface of the casing 11. The input display portion 12 is, for example, a touch panel. The input display portion 12 is configured to display various information on a screen and enable operation to the information displayed on the screen.

The thermal printer 13 is mounted at a position adjacent to the discharge port 18 in the casing 11. The thermal printer 13 is configured to print information on the recording paper P, which is fed from the recording paper receiving portion 17, and to discharge the recording paper P through the discharge port 18.

Figure 2:
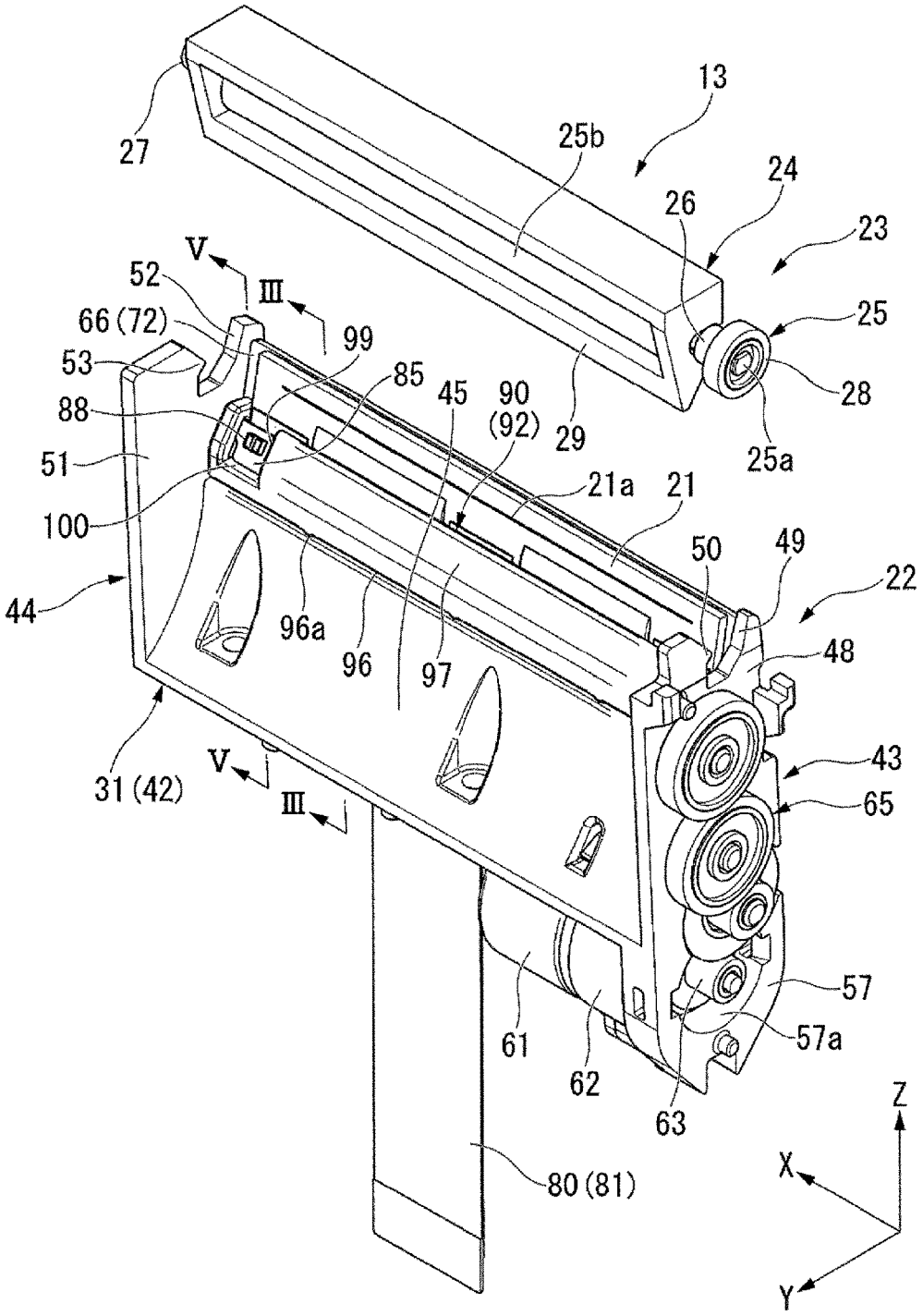
FIG. 2 is an exploded perspective view of a thermal printer according to the embodiment of the present invention.

FIG. 2 is an exploded perspective view of the thermal printer 13. As illustrated in FIG. 2, the thermal printer 13 includes a head unit 22 and a platen unit 23. The head unit 22 includes a thermal head 21. The platen unit 23 includes a platen roller 25. In the example illustrated in FIG. 1, the head unit 22 is assembled to the casing main body 15. The platen unit 23 is assembled to the printer cover 16. The printer cover 16 has a support shaft in a lower portion of FIG. 1, and is opened toward a left front side of FIG. 1. At that time, the platen unit 23 moves to follow the printer cover 16. With this action, connection between the platen unit 23 and the head unit 22 is released so that the recording paper is brought into a free state. Conversely, when the printer cover 16 is closed, the platen unit 23 also moves to follow the printer cover 16. At this time, the platen unit 23 returns to a position in contact with the thermal head 21 of the head unit 22. As described above, the head unit 22 and the platen unit 23 are combined so as to be approachable and separable along with opening and closing of the printer cover 16. When the printer cover 16 takes a closed position, the thermal head 21 of the head unit 22 and the platen roller 25 of the platen unit 23 are opposed to each other across the above-mentioned discharge port 18. In the following description, an axial direction of the platen roller 25 is described as an X direction (first direction), and two directions orthogonal to the X direction are described as a Y direction and a Z direction. Further, in the following description, in each of the X direction, the Y direction, and the Z direction, a direction indicated by the arrow in the drawings is described as a plus direction, and a direction opposite to the arrow is described as a minus direction.

The platen unit 23 includes a platen frame 24 and the above-mentioned platen roller 25. First, when the printer cover 16 takes the closed position, and the head unit 22 and the platen unit 23 are combined with each other, the platen roller 25 nips the recording paper P with the thermal head 21 to convey the recording paper P toward the discharge port 18. The platen roller 25 includes a platen shaft 25*a* and a roller main body 25*b*.

The platen shaft 25*a* extends in the X direction. At both end portions of the platen shaft 25*a* in the X direction, there are mounted a first bearing 26 and a second bearing 27, respectively. At a portion of the platen shaft 25*a*, which is located in a minus X direction with respect to the first bearing 26, there is provided a driven gear 28. The roller main body 25*b* is made of, for example, rubber. The roller main body 25*b* is externally mounted to a portion of the platen shaft 25*a* other than the both end portions of the platen shaft 25*a* in the X direction.

Figure 3:
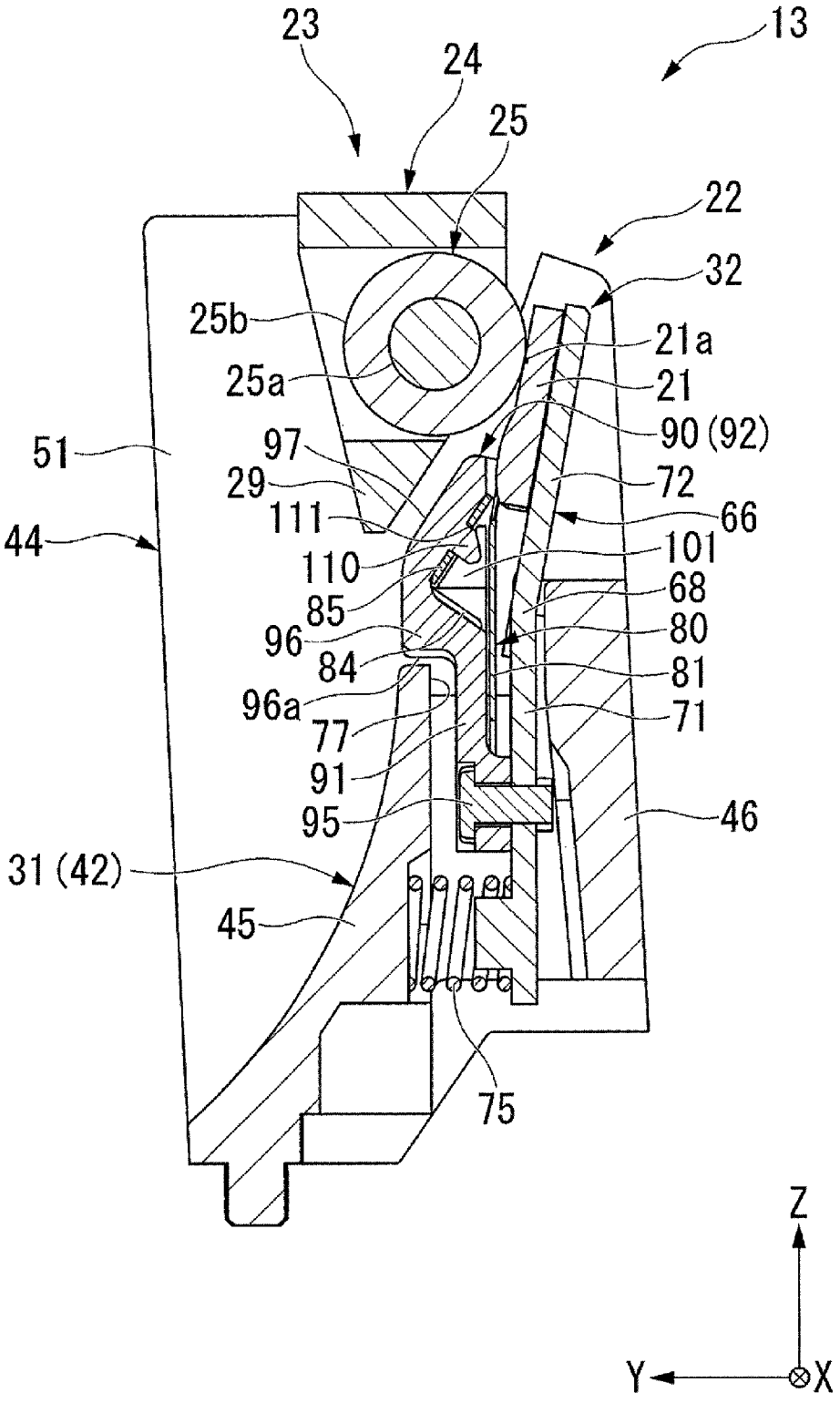
FIG. 3 is a sectional view taken along the line of FIG. 2.

FIG. 3 is a sectional view taken along the line III-III of FIG. 2. The platen frame 24 is fixed to the printer cover 16 and rotatably supports the both end portions of the above-mentioned platen shaft 25*a* in the X direction. The platen frame 24 may be integrally provided to the printer cover 16.

A portion of the platen frame 24, which is located in a minus Z direction from the platen roller 25, constructs a recording paper guide 29. The recording paper guide 29 is arranged close to or in contact with the recording paper P from a plus Z direction to guide the recording paper P toward the thermal head 21. In this embodiment, the recording paper guide 29 is formed to have a triangular shape in side view from the X direction. Specifically, an end portion of the recording paper guide 29 in the minus Y direction and the minus Z direction extends in the plus Z direction toward the minus Y direction.

Further, as illustrated in FIG. 2, the recording paper guide 29 is formed to have a length in the X direction, which is larger than that of the roller main body 25*b*. Thus, the recording paper guide 29 entirely supports the recording paper P in the X direction from the plus Z direction. However, the shape of the recording paper guide 29 or the length of the recording paper guide 29 in the X direction may be changed as appropriate. For example, the recording paper guide 29 may be configured to partially support the recording paper P in the X direction from the plus Z direction.

The head unit 22 mainly includes a head frame (frame) 31 and a head block 32 supported on the head frame 31. The head frame 31 is formed into a U-shape which is opened in the plus Z direction in front view from the Y direction. Specifically, the head frame 31 includes a base portion 42, a first side plate portion 43, and a second side plate portion 44. The base portion 42 extends in the X direction. The first side plate portion 43 and the second side plate portion 44 are continuously formed on both end portions of the base portion 42 in the X direction. The base portion 42 includes a guide wall 45 and a back surface plate 46 (see FIG. 3). The guide wall 45 is located in a plus Y direction of the base portion 42. The back surface plate 46 is located in the minus Y direction with respect to the guide wall 45. A surface of the guide wall 45, which is oriented in the plus Y direction, constructs a paper passage surface configured to guide the recording paper P in the plus Z direction (conveyance direction). The paper passage surface is a curved surface which protrudes in the minus Y direction.

As illustrated in FIG. 3, the back surface plate 46 is arranged so as to be opposed to the guide wall 45 at an interval in the Y direction. Both end portions of the back surface plate 46 in the X direction are connected to the guide wall 45 (see FIG. 5).

As illustrated in FIG. 2, the first side plate portion 43 is connected to an end portion of the base portion 42, which includes the guide wall 45 and the back surface plate 46, in the minus X direction. A portion of the first side plate portion 43, which protrudes in the plus Z direction with respect to the base portion 42, constructs a first shaft support portion 48. At an end edge of the first shaft support portion 48 in the plus Z direction, there is formed a first roller receiving groove 49 which is recessed in the minus Z direction. At a portion of an inner peripheral edge of the first roller receiving groove 49, which is located in the plus Y direction, there is formed a first hook portion 50 which protrudes in the minus Y direction. A portion of the first side plate portion 43, which protrudes in the minus Z direction with respect to the base portion 42, constructs a motor support portion 57.

The second side plate portion 44 is continuously formed on an end portion of the base portion 42 in a plus X direction. A portion of the second side plate portion 44, which protrudes in the plus Z direction with respect to the base portion 42, constructs a second shaft support portion 51. At an end edge of the second shaft support portion 51 in the plus Z direction, there is formed a second roller receiving groove 52 which is recessed in the minus Z direction. At a portion of an inner peripheral edge of the second roller receiving groove 52, which is located in the plus Y direction, there is formed a second hook portion 53 which protrudes in the minus Y direction.

The bearings 26 and 27 of the above-mentioned platen roller 25 are received in the above-mentioned roller receiving grooves 49 and 52, respectively. Under a state in which the platen roller 25 is received in the roller receiving grooves 49 and 52, the hook portions 50 and 53 are engaged with corresponding bearings 26 and 27 of the platen roller 25 from the plus Z direction. With this action, the platen roller 25 is supported on the shaft support portions 48 and 51 (head frame 31) so as to be rotatable about an axis extending in the X direction and so as to be removable from the head frame 31. Under the state in which the platen roller 25 is retained in the roller receiving grooves 49 and 52, the above-mentioned driven gear 28 is positioned in the minus X direction from the first shaft support portion 48. Further, under the state in which the platen roller 25 is retained in the roller receiving grooves 49 and 52, the above-mentioned platen frame 24 is opposed to the base portion 42 in the Z direction on an inner side of the shaft support portions 48 and 51.

At a portion of the above-mentioned head frame 31, which is located in the plus X direction with respect to the motor support portion 57, there is arranged a motor 61. The motor 61 is arranged under a state in which a rotary shaft (not shown) thereof protrudes in the minus X direction.

Between the motor 61 and the motor support portion 57 in the X direction, there is arranged a first speed reduction mechanism 62 configured to reduce power of the motor 61. The first speed reduction mechanism 62 is, for example, a planetary gear mechanism. The first speed reduction mechanism 62 has an output gear 63 which protrudes in the minus X direction. The output gear 63 protrudes through a through hole 57*a*, which is formed in the motor support portion 57, in the minus X direction with respect to the motor support portion 57.

At a portion which is located in the minus X direction with respect to the above-mentioned first side plate portion 43, there is arranged a second speed reduction mechanism 65. The second speed reduction mechanism 65 is a gear train mechanism including a two-step gear. The second speed reduction mechanism 65 provides connection between the output gear 63 of the first speed reduction mechanism 62 and the driven gear 28 of the platen roller 25. The second speed reduction mechanism 65 is covered with a gear cover (not shown) from the minus X direction.

As illustrated in FIG. 2 and FIG. 3, the head block 32 includes a head support plate 66 and the above-mentioned thermal head 21 supported on the head support plate 66. As illustrated in FIG. 3, the head support plate 66 has a plate-like shape having a thickness direction in the Y direction. The head support plate 66 is turnable at a support portion (not shown), which is formed on the back surface plate 46, as a support point with respect to the head frame 31 about an axis extending in the X direction so that the thermal head 21 approaches and separates from the platen roller 25.

The head support plate 66 includes a bent portion 68, an urging portion 71, and a head mounting portion 72. The bent portion 68 is located at a center portion of the support plate 66 in the Z direction. The urging portion 71 is located in the minus Z direction with respect to the bent portion 68. The heat mounting portion 72 is located in the plus Z direction with respect to the bent portion 68. The bent portion 68 is bent so as to cause the head support plate 66 to protrude in the plus Y direction. The bent portion 68 linearly extends over an entire region of the head support plate 66 in the X direction (width direction). At both end portions of the head support plate 66 in the X direction, and in the vicinity of the bent portion 68, there are formed engagement portions (not shown). The engagement portions are engaged, at least in the Z direction, with engaged portions (not shown) formed in the head frame 31. With this, movement of the head block 32 with respect to the head frame 31 in the Z direction is regulated.

The urging portion 71 is arranged in an assembly hole 77 of the above-mentioned base portion 42, which is defined by the guide wall 45 and the back surface plate 46. Urging members 75 are interposed between an end portion of the urging portion 71 in the minus Z direction and the guide wall 45 of the head frame 31. The urging members 75 are cylindrical coil springs each having an axial direction in the Y direction. The urging members 75 urge the urging portion 71 and the guide wall 45 in a direction of separating the urging portion 71 and the guide wall 45 from each other in the Y direction. The urging members 75 are not limited to the cylindrical coil springs. There may be used conical coil springs, leaf springs, or the like as the urging members 75. Further, the above-mentioned assembly hole 77 penetrates through the head frame 31 in the Z direction.

The head mounting portion 72 extends in the plus Z direction from an end edge (bent portion 68) of the urging portion 71 in the plus Z direction. An end portion of the head mounting portion 72 in the plus Z direction has a larger width in the X direction as compared to an end portion of the head mounting portion 72 in the minus Z direction. The shape of the head support plate 66 may be changed as appropriate. For example, the entire head support plate 66 may be formed linearly.

The thermal head 21 is attached and fixed to the end portion of the head mounting portion 72 of the above-mentioned head support plate 66 in the plus Z direction from the plus Y direction. The thermal head 21 has a plate-like shape extending in the X direction. On an end surface (hereinafter referred to as "head surface") of the thermal head 21, which is oriented in the plus Y direction, a plurality of heating elements 21*a* are arrayed in the X direction at intervals. The head surface of the thermal head 21 is brought into press-contact with an outer peripheral surface of the platen roller 25 (roller main body 25*b*) by urging force of the above-mentioned urging members 75 under a state in which the recording paper P is nipped between the head surface of the thermal head 21 and the outer peripheral surface of the platen roller 25. In this embodiment, under a state in which the head unit 22 and the platen unit 23 are combined with each other, the head surface of the thermal head 21 is arranged so as to be inclined in the Z direction, specifically, so as to extend in the minus Y direction toward the plus Z direction.

Figure 4:
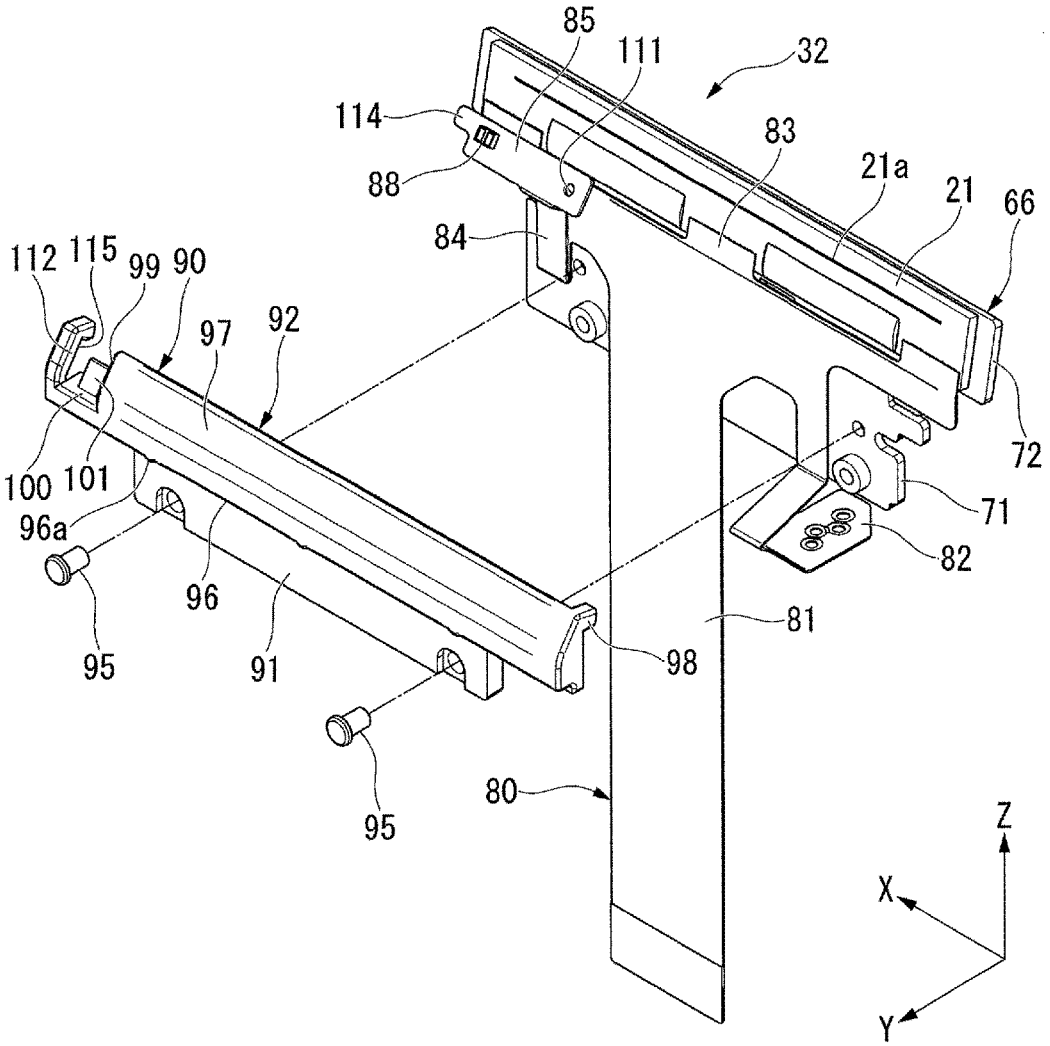
FIG. 4 is an exploded perspective view of a head unit in the thermal printer according to the embodiment of the present invention.

FIG. 4 is an exploded perspective view of the head unit 22. A flexible board (wiring board) 80 is connected to the above-mentioned thermal head 21 and motor 61 and the like. The flexible board 80 includes a drawn portion 81, and a motor connection portion 82, a head connection portion 83, and a sensor connection portion 84, which branch out from the drawn portion 81.

The drawn portion 81 is drawn from a controller (not shown) provided in the casing 11. The controller is connected to a power supply (not shown) in the casing 11. The motor connection portion 82 branches out in the minus X direction from an end portion of the drawn portion 81 in the plus Z direction. The motor connection portion 82 extends in the minus Z direction and is electrically connected to the above-mentioned motor 61. The head connection portion 83 branches out in the plus Z direction from the end portion of the drawn portion 81 in the plus Z direction. The head connection portion 83 is electrically connected to the above-mentioned thermal head 21.

The sensor connection portion 84 branches out in the plus X direction from the end portion of the drawn portion 81 in the plus Z direction. The sensor connection portion 84 extends in the minus Z direction and is folded back in the plus Z direction. In a distal end portion of the sensor connection portion 84, there is formed a sensor mounting portion 85 having a width in the X direction, which is larger than that of the sensor connection portion 84. On a surface of the sensor mounting portion 85, which is oriented in the plus Y direction (hereinafter referred to as "mounting surface"), a recording paper sensor 88 is mounted. The thermal head 21, the motor 61, and the recording paper sensor 88 receive power supplied from a power supply and perform input and output of signals with the controller through a wiring pattern formed in the flexible board 80.

The recording paper sensor 88 is an optical sensor (for example, a photo sensor of a reflection type). The recording paper sensor 88 is mounted at an end portion in the plus X direction on the mounting surface of the sensor mounting portion 85. The recording paper sensor 88 includes a light emitter and a light receiver. Light emitted from the light emitter is reflected on the recording paper P, and the reflected light can be detected by the light receiver. For example, when the reflected light is detected by the light receiver of the recording paper sensor 88, the above-mentioned controller determines that the recording paper P is present within a detection range of the recording paper sensor 88.

The sensor mounting portion 85 is held on the head block 32 by a sensor holder 90. The sensor holder 90 is integrally made of a resin material or the like. Specifically, the sensor holder 90 includes a mounting portion 91 and a holder portion 92 connected to the mounting portion 91 in the plus Z direction.

As illustrated in FIG. 3 and FIG. 4, the mounting portion 91 is arranged in the plus Y direction with respect to the urging portion 71 of the above-mentioned head support plate 66. The mounting portion 91 is fixed by screws 95 at positions of the urging portion 71, which are located in the plus Z direction from the urging members 75 and avoid the above-mentioned drawn portion 81. In this case, as illustrated in FIG. 2 and FIG. 3, the mounting portion 91 is arranged in the assembly hole 77 so as to be spaced apart from the guide wall 45 in the Y direction. The sensor holder 90 is turnable together with the head block 32 with respect to the head frame 31. The mounting portion 91 does not protrude from an end edge of the guide wall 45 in the plus Z direction.

As illustrated in FIG. 3 and FIG. 4, the holder portion 92 is positioned in the plus Z direction with respect to the guide wall 45. In this embodiment, the holder portion 92 covers the head connection portion 83 and the sensor connection portion 84 of the flexible board 80 both in the plus Y direction and the X direction. The holder portion 92 has a length in the X direction, which is slightly smaller than that of the guide wall 45, and is arranged over a substantially entire region on the inner side of the above-mentioned shaft support portions 48 and 51.

The holder portion 92 has a bottom wall portion 96 extending in the plus Y direction from an upper end edge of the mounting portion 91 in the plus Z direction. The bottom wall portion 96 has an end edge in the plus Y direction, which is opposed in the Z direction with respect to the end surface of the guide wall 45 in the plus Z direction. In the state illustrated in FIG. 3, the end edge of the bottom wall portion 96 in the plus Y direction does not protrude in the minus Y direction with respect to the end surface of the guide wall 45 in the plus Z direction. The bottom wall portion 96 has a plurality of protruding portions 96*a*, which protrude in the minus Z direction, at intervals in the Y direction. Further, the bottom wall portion 96 may be positioned in the minus Y direction with respect to the end surface of the guide wall 45 in the plus Z direction, that is, may be positioned so as not to be opposed to the guide wall 45 in the Z direction.

As illustrated in FIG. 3, the holder portion 92 includes a cover portion 97 which extends in the plus Z direction from an end edge of the bottom wall portion 96 in the plus Y direction. The cover portion 97 extends in the plus Z direction from the end edge of the bottom wall portion 96 in the plus Y direction and is inclined in the minus Y direction toward the plus Z direction. A surface of the cover portion 97, which is oriented in the plus Y direction, constructs a guide surface configured to guide the recording paper P to the thermal head 21. The guide surface is smoothly connected to the paper passage surface of the guide wall 45. In sectional view from the X direction, an end portion of the guide surface in the plus Z direction (conveyance path P1 of the recording paper P) extends in a direction intersecting a tangential direction of the head surface of the thermal head 21. In this embodiment, the end portion of the cover portion 97 in the plus Z direction overlaps with the end portion of the thermal head 21 in the minus Z direction as viewed from the Y direction. However, the end edge of the cover portion 97 in the plus Z direction may be positioned in the minus Z direction from the thermal head 21.

Under the state in which the head unit 22 and the platen unit 23 are combined with each other, the above-mentioned guide surface of the cover portion 97 is covered by the recording paper guide 29 from the plus Z direction and the plus Y direction. The recording paper P is conveyed to the thermal head 21 through a space between the guide surface and the recording paper guide 29. That is, the recording paper P is conveyed in the minus Y direction toward the plus Z direction between the cover portion 97 and the recording paper guide 29.

As illustrated in FIG. 4, abutment portions 98 are formed on both end portions of the cover portion 97 in the X direction. The abutment portions 98 protrude in the minus Y direction from the end portions of the cover portion 97 in the plus Z direction. End surfaces of the abutment portions 98 in the minus Y direction are held in abutment against the head mounting portion 72 of the head support plate 66 from the plus Y direction.

At a portion of the end portion of the cover portion 97 in the plus X direction, which overlaps with the recording paper sensor 88 as viewed from the Y direction, there is formed a passing hole 99 which exposes the recording paper sensor 88. The passing hole 99 passes through the cover portion 97 in the Y direction, and is opened in the plus Z direction on the end edge of the cover portion 97 in the plus Z direction.

Figure 5:
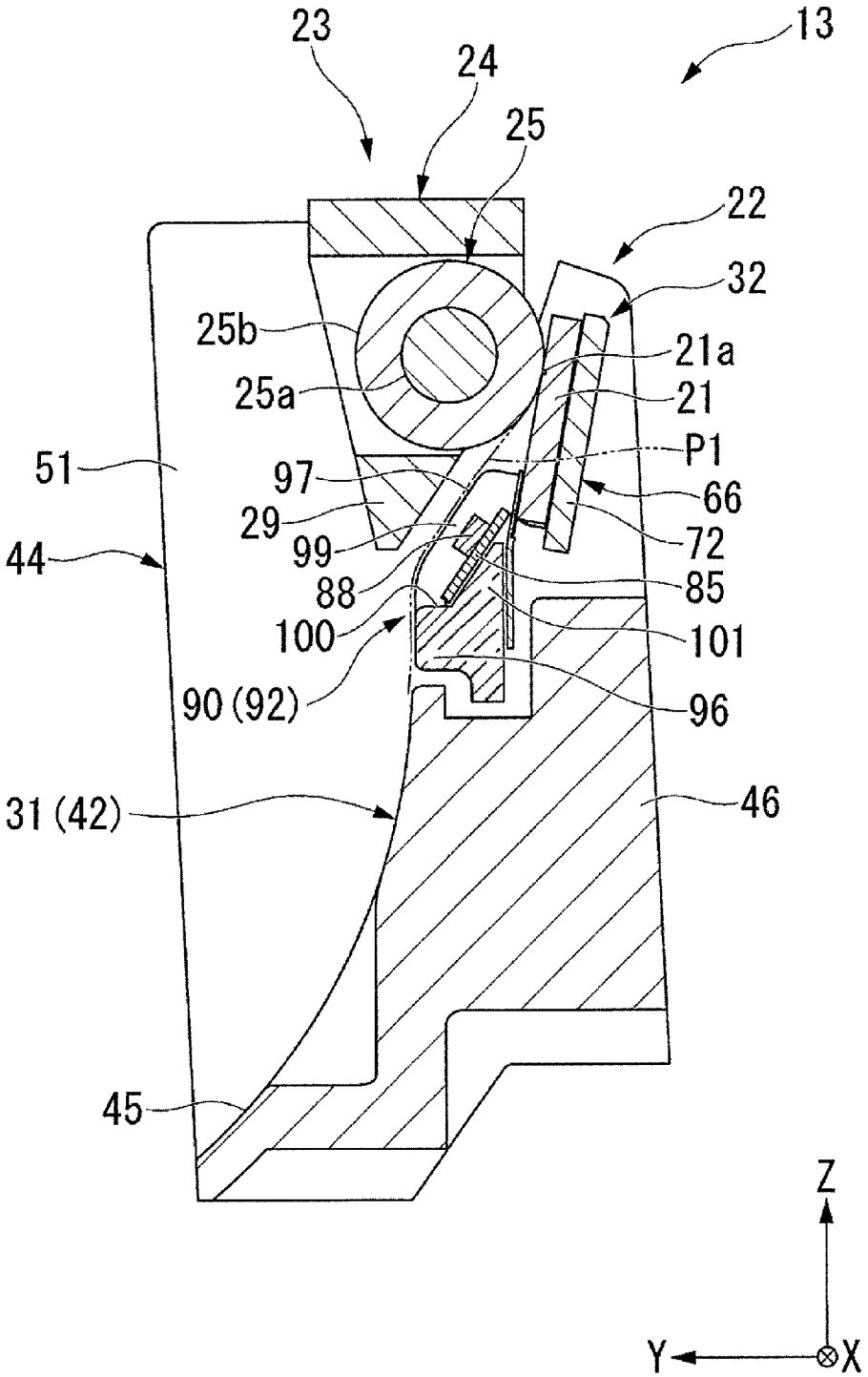
FIG. 5 is a sectional view taken along the line V-V of FIG. 2.

FIG. 5 is a sectional view taken along the line V-V of FIG. 2. As illustrated in FIG. 4 and FIG. 5, at a portion of an opening edge of the passing hole 99, which is located in the minus Z direction, there is formed a seat portion 100 which protrudes in the minus Y direction. The seat portion 100 supports the above-mentioned sensor mounting portion 85 from the minus Z direction. On the seat portion 100, there is formed a holding portion 101 which protrudes in the plus Z direction. The holding portion 101 has a triangular shape in sectional view as viewed from the X direction. Specifically, the holding portion 101 constructs a holding surface having a surface oriented in the plus Y direction, which extends in the minus Y direction toward the plus Z direction. The holding surface supports the sensor mounting portion 85 from the minus Y direction. Thus, the sensor mounting portion 85 (recording paper sensor 88) of this embodiment is arranged in conformity with the guide surface of the cover portion 97 (conveyance path P1 of the recording paper P). That is, the sensor mounting portion 85 is arranged with inclination with respect to the head surface of the thermal head 21. With this configuration, in a normal line of the recording paper P which passes along the guide surface, the recording paper sensor 88 and the recording paper P can be arranged so as to be opposed to each other.

In sectional view as viewed from the X direction, an angle of the sensor mounting portion 85 (recording paper sensor 88) with respect to the head surface of the thermal head 21 is set to, for example, about from 10° to 20°. As described above, the cover portion 97 is covered by the recording paper guide 29 from the plus Z direction and the plus Y direction, with the result that ambient light which may enter the recording paper sensor 88 is blocked by the recording paper guide 29. That is, the recording paper guide 29 of this embodiment has both a function of guiding the recording paper P to the thermal head 21 and a function as a blocking member for the recording paper sensor 88.

As illustrated in FIG. 3, at a portion of the above-mentioned cover portion 97, which is located in the minus X direction with respect to the recording paper sensor 88, there is formed a positioning pin 110 which protrudes toward the sensor mounting portion 85. The positioning pin 110 is inserted into a positioning hole 111 formed in the above-mentioned sensor mounting portion 85. Further, as illustrated in FIG. 4, in a side wall portion 112 of the holder portion 92, which is located in the plus X direction, there is formed a locked portion 115 which penetrates through the side wall portion 112 in the X direction. The locked portion 115 receives a locking portion 114 which protrudes in the plus X direction from the sensor mounting portion 85. The locking portion 114 can be locked to an inner peripheral surface of the locked portion 115 from the minus Z direction.

Next, an operation method of the above-mentioned portable terminal 1 is described. In the following description, it is assumed that a leading edge of the recording paper P is nipped between the platen roller 25 and the thermal head 21. In the portable terminal 1, printing on the recording paper P is started through operation to the input display portion 12. Specifically, a signal is output from the controller to the motor 61 through, for example, the flexible board 80, with the result that the motor 61 rotates. The power of the motor 61 is reduced by the first speed reduction mechanism 62 and the second speed reduction mechanism 65 and thereafter is transmitted to the driven gear 28. With this, the platen roller 25 is rotated. Then, the recording paper P nipped between the outer peripheral surface of the platen roller 25 and the thermal head 21 is delivered toward the discharge port 18.

When the signal is output from the controller to the thermal head 21 through the flexible board 80 during the course of delivering the recording paper P through rotation of the platen roller 25, the heating elements 21*a* of the thermal head 21 generate heat as appropriate. With this, various information is printed on the recording paper P. Then, the recording paper P discharged through the discharge port 18 is cut and used as, for example, a receipt.

Next, an action of the thermal printer 13 according to this embodiment is described. In the following description, a method of assembling the head block 32 to the head frame 31 in the head unit 22 is mainly described. First, under a state in which the flexible board 80 is connected to the head block 32, the sensor mounting portion 85 is assembled to the sensor holder 90. Specifically, under a state in which the sensor mounting portion 85 is set on the holding portion 101, the positioning pin 110 is inserted into the positioning hole 111, and the locking portion 114 is inserted into the locked portion 115. With this, the sensor mounting portion 85 (recording paper sensor 88) is held by the sensor holder 90. Next, the mounting portion 91 of the sensor holder 90 is assembled to the head block 32 by the screws 95. With this, the recording paper sensor 88 is brought into the state of being assembled to the head block 32 in advance.

Next, the head block 32 is assembled to the head frame 31. Specifically, the drawn portion 81 of the flexible board 80 is allowed to enter the assembly hole 77 of the head frame 31 from the plus Z direction. After that, the urging portion 71 of the head block 32 and the mounting portion 91 of the sensor holder 90 are allowed to enter the assembly hole 77. Then, in the assembly hole 77, the engagement portions of the head support plate 66 are engaged with the engaged portions of the head frame 31, and the urging members 75 are interposed between the urging portion 71 of the head support plate 66 and the guide wall 45. In the above-mentioned manner, the head block 32 is assembled to the head frame 31.

As described above, in this embodiment, the sensor holder 90 which holds the recording paper sensor 88 at a portion located between the thermal head 21 and the guide wall 45 in the conveyance direction (Z direction) of the recording paper P is mounted to the head block 32. With this configuration, the recording paper sensor 88 is mounted to the head block 32 through intermediation of the sensor holder 90. Accordingly, the recording paper sensor 88 can be fixed in advance before the head block 32 is mounted to the head frame 31. Therefore, as compared to the case of mounting the recording paper sensor to the head frame in the related art, ease of assembly can be improved. Further, the recording paper sensor 88 is held at a portion of the sensor holder 90 being turnable with the head block 32, which is located in the plus Z direction from the guide wall 45. Accordingly, the recording paper sensor 88 can be arranged in the vicinity of the thermal head 21. Therefore, when the PI sensor is used as the recording paper sensor 88, the blocking member such as the recording paper guide 29 can be downsized. As a result, the thermal printer 13 can be downsized particularly in the Y direction. Further, unlike the case of directly mounting the recording paper sensor to the thermal head in the related art, the shape of the sensor holder 90 or an inclination angle of the holding portion 101 is changed in accordance with the conveyance path P1 of the recording paper P (see FIG. 5). Accordingly, the recording paper sensor 88 can be laid out with a desired position or orientation in accordance with the conveyance path P1 of the recording paper P. As a result, the degree of freedom in design of the conveyance path P1 of the recording paper P can be improved.

In this embodiment, the cover portion 97 of the sensor holder 90 covers the recording paper sensor 88, and the recording paper P is guided to the thermal head 21 between the guide wall 45 and the thermal head 21. With this configuration, the sensor holder 90 covers portions other than the recording paper sensor 88 with the cover portion 97, thereby being capable of suppressing entry of light into the recording paper sensor 88 through portions other than the passing hole 99. Therefore, erroneous detection by the recording paper sensor 88 due to the ambient light can be suppressed, thereby being capable of improving the detection accuracy of the recording paper sensor 88. Further, the recording paper P is conveyed to the thermal head 21 along the cover portion 97. Therefore, the conveyance of the recording paper P is prevented from being hindered by the sensor holder 90, thereby being capable of smoothly guiding the recording paper P to the thermal head 21.

In this embodiment, the sensor holder 90 is mounted to the head support plate 66 which is larger than the thermal head 21, thereby being capable of improving ease of layout of the sensor holder 90 as compared to the case of mounting the sensor holder 90 to the thermal head 21.

In this embodiment, the recording paper sensor 88 is arranged in conformity with the conveyance path P1 of the recording paper P, which extends in the direction intersecting the head surface, thereby being capable of allowing the recording paper P and the recording paper sensor 88 to be opposed to each other in the normal direction of the recording paper P. Therefore, the recording paper P can easily be conveyed within the detection range of the recording paper sensor 88, thereby being capable of improving the detection accuracy of the recording paper sensor 88.

The portable terminal 1 of this embodiment includes the above-mentioned thermal printer 13, thereby being capable of providing the portable terminal 1 with high reliability.

The technical scope of the present invention is not limited to the above-mentioned embodiment, and various modifications may be made without departing from the gist of the present invention.

In the above-mentioned embodiment, description is made of the case where the payment terminal is used as one example of the portable terminal 1. However, the present invention is not limited to this configuration, and the configuration of the present invention may be applied to various types of portable terminals. In the above-mentioned embodiment, description is made of the case where the photo sensor of the reflection type is used as the recording paper sensor. However, the present invention is not limited only to this configuration. For example, a PI sensor of a transmission type or a mechanical sensor may be used. In the above-mentioned embodiment, description is made of the configuration in which the sensor holder 90 includes the cover portion 97. However, the present invention is not limited only to this configuration. That is, as long as the recording paper sensor 88 can be mounted to the head block 32, the configuration of the sensor holder may be changed as appropriate. In this case, the sensor holder need not be formed entirely along the width direction of the recording paper P, and may be formed only at a portion holding the recording paper sensor 88. Further, in the above-mentioned embodiment, description is made of the configuration in which the mounting portion 91 is located in the assembly hole 77. However, the present invention is not limited only to this configuration.

In the above-mentioned embodiment, description is made of the configuration in which the sensor holder 90 is mounted to the head support plate 66. However, the present invention is not limited only to this configuration, and the sensor holder may be mounted to the thermal head 21. In the above-mentioned embodiment, description is made of the configuration in which the recording paper guide 29 blocks the ambient light which may enter the recording paper sensor 88. However, another blocking member may be provided separately from the recording paper guide 29.

Besides the above, the components in the above-mentioned embodiment may be replaced by well-known components as appropriate without departing from the gist of the present invention. The above-mentioned modified examples may be combined with each other as appropriate.

What is claimed is:

1. A thermal printer, comprising:

a head block including a head support plate and a thermal head fixed to the head support plate;

a platen roller brought into abutment against the thermal head through intermediation of recording paper;

a wiring board connected to and extending from the thermal head;

a frame supporting the platen roller and the head support plate; and a recording paper sensor mounted to the wiring board and configured to detect the recording paper, the frame including a guide wall at an upstream side of the thermal head in a conveyance direction of the recording paper, the guide wall guiding the recording paper to the thermal head, the head block including a sensor holder mounted thereto, the sensor holder covering a portion of the wiring board and including a holding portion that positions the recording paper sensor between the thermal head and the guide wall in the conveyance direction.

2. A thermal printer according to claim 1, wherein the frame is configured to support the platen roller rotatably about an axis extending in a first direction, and is configured to support the head support plate turnably in directions of causing the thermal head to approach and separate from the platen roller about a turn axis extending in the first direction.

3. A thermal printer according to claim 2, wherein the recording paper sensor comprises an optical sensor, wherein the sensor holder includes a cover portion covering the recording paper sensor, the cover portion guiding the recording paper to the thermal head between the guide wall and the thermal head, and wherein the cover portion includes a passing hole which allows light emitted from the recording paper sensor to pass.

4. A thermal printer according to claim 3, wherein the sensor holder is mounted to the head support plate.

5. A thermal printer according to claim 4, wherein a head surface of the thermal head, which is brought into abutment against the platen roller, extends in a direction intersecting a conveyance path of the recording paper connecting the guide wall and the thermal head to each other, and wherein the recording paper sensor is arranged in conformity with the conveyance path.

6. A portable terminal, comprising:

the thermal printer of claim 5; and a casing to which the thermal printer is mounted.

7. A thermal printer according to claim 1, wherein the recording paper sensor comprises an optical sensor, wherein the sensor holder includes a cover portion covering the recording paper sensor, the cover portion guiding the recording paper to the thermal head between the guide wall and the thermal head, and wherein the cover portion includes a passing hole which allows light emitted from the recording paper sensor to pass.

8. A thermal printer according to claim 1, wherein the sensor holder is mounted to the head support plate.

9. A thermal printer according to claim 1, wherein a head surface of the thermal head, which is brought into abutment against the platen roller, extends in a direction intersecting a conveyance path of the recording paper connecting the guide wall and the thermal head to each other, and wherein the recording paper sensor is arranged in conformity with the conveyance path.

10. A portable terminal, comprising:

the thermal printer of claim 1; and a casing to which the thermal printer is mounted.

* * * * *